United States Patent [19]

Iwasaki

[11] Patent Number: 4,701,365

[45] Date of Patent: Oct. 20, 1987

[54] FORMABLE NONWOVEN SHEET

[75] Inventor: Hirofumi Iwasaki, Ashiya, Japan

[73] Assignee: Asahi Kasei Kogyo Kabushiki Kaisha, Japan

[21] Appl. No.: 921,681

[22] Filed: Oct. 22, 1986

[30] Foreign Application Priority Data

May 28, 1986 [JP] Japan ..... 61-121238

[51] Int. Cl.[4] ..... B32B 5/14

[52] U.S. Cl. ..... 428/171; 28/116; 156/62.2; 156/62.4; 428/198; 428/224; 428/288; 428/409

[58] Field of Search ..... 428/198, 224, 288, 171, 428/409; 156/62.2, 62.4; 28/116

[56] References Cited

U.S. PATENT DOCUMENTS 3,523,149 8/1970 Hartmann ..... 264/90

3,847,729 11/1974 Hartmann ..... 264/90

4,578,307 3/1986 Niki et al. ..... 428/288

*Primary Examiner*—Marion C. McCamish

*Attorney, Agent, or Firm*—Finnegan, Henderson, Farabow, Garrett & Dunner

[57] ABSTRACT

Disclosed is a formable nonwoven sheet of filaments of a polyester group and having superior forming properties, i.e., a forming processability and a shape retaining property and utilizability, i.e., physical properties and properties during use, produced by controlling a state of bonding between each single filament in the nonwoven sheet, which state of bonding is expressed by a relationship between a needle piercing resistance value and a hooking resistance value in a predetermined range.

A formable nonwoven sheet having a smooth surface can be obtained by heat treating an intermediate nonwoven sheet while controlling an area shrinkage of the intermediate nonwoven sheet caused by the heat, by holding the intermediate nonwoven sheet from both sides while a formable nonwoven sheet having a high flexural endurance can be obtained by heat treating the intermediate nonwoven sheet while allowing the intermediate nonwoven sheet to be shrunk by heat from steam or boiling water.

17 Claims, 10 Drawing Figures

FORMABLE NONWOVEN SHEET

BACKGROUND OF THE INVENTION (1) Field of the Invention

The present invention relates to a nonwoven sheet composed of filaments of a polyester group and a method for producing these sheets. More particularly, the present invention relates to a formable nonwoven sheet having a superior forming property and a good utilizability.

(2) Description of the Prior Art

Nonwoven fabrics have been widely used in place of knitted cloth or woven cloth, but in the most cases, the nonwoven sheet is used as a sheet per se. The nonwoven sheet, especially the nonwoven sheet made by a spun bond system has an air permeability, water permeability, and cushioning property. Therefore, if it is possible to use this nonwoven sheet as a forming material, new applications impossible to achieve by a conventional forming material can be developed.

Where the nonwoven sheet is used as the forming material, the nonwoven sheet should have a superior forming processability and a superior shape retaining property. The superior forming processability makes it possible to produce a formed part or a formed pieces having high convex portions and deep concave portions and/or a complicated shape, in a broad range of forming temperatures. Because of the superior shape retaining property, the formed part is not easily deformed by an external force and the shape of the formed part is not shrunk or deformed by heat. In the description hereafter, a combination of the forming processability and the shape retaining property is referred to as the forming property.

Further, the formed part made of the nonwoven sheet should have a good utilizability. This good utilizability is divided into physical properties and properties during use. For the physical properties, the abrasion resistance of a surface of the nonwoven sheet should be excellent, with little occurrence of fuzz, and the nonwoven sheet should have an adequate air permeability and water permeability. In all applications, the formable nonwoven sheet should have these good physical properties. With regard to the properties during use, the values of the properties during use depend on the applications for which the formable nonwoven sheet is used. For example, when the formable nonwoven sheet is used as a wrapping material and letters and/or marks are printed on a surface of the formed part made of the formable nonwoven sheet, the formable nonwoven sheet must have a smooth surface and a good printability, so that minute lettering or marks can be clearly printed on the surface thereof. If the formed part of the formable nonwoven sheet is used as a core material, for example, a member holding the shape of a shoe and arranged between a surface leather and an inside lining, the formable nonwoven sheet must have a good flexural endurance property, i.e. a property that after the formed part is bent by an external force, the shape of formed part can speedily recover its original shape by removing the external force. At the present time, the formable nonwoven sheet having the above-mentioned properties are not available in the market.

Japanese Unexamined Patent Publication (Kokai) No. 51-40475 discloses a method for improving the forming properties by partially cutting filaments by a needle punching operation. But when a deep draw forming is performed or a formed part having a complicated shape is produced by using this nonwoven sheet, irregular slippage between the filaments occurs, and a thickness irregularity caused by the irregular slippage of the filaments may occur in the nonwoven sheet. Further, the formed part formed by using this nonwoven sheet may be deformed, so that the shape retaining property becomes poor.

U.S. Pat. No. 3,523,149 and U.S. Pat. No. 3,847,729 discloses that a nonwoven sheet made of undrawn filaments was used as the forming material on the basis that a known undrawn filament has a large breaking elongation and shrinkable property. However, this nonwoven sheet can be only used in specific fields such as a vacuum forming material formed by using a mass volume of an adhesive and by laminating with a polymer foil, and cannot be used as a general formable nonwoven sheet. Further, this nonwoven sheet is easily deteriorated by heat, and thus a temperature used in a forming process must be kept at a low level. Accordingly, a formed part produced by using this nonwoven sheet has a poor heat setting property and is easily deformed by heat.

The same applicant as that of the present application proposed a method for stretch-setting a nonwoven sheet under a dry heating condition, using a nonwoven sheet composed of undrawn filaments as a forming material (see Japanese Unexamined Patent Publication (Kokai) No. 60-199961 and Corresponding U.S. Pat. No. 4,578,307). This nonwoven sheet has an excellent forming processability, because it can be easily elongated and deformed at a high temperature. However, since filaments constituting this nonwoven sheet are only interlaced in a partial-heat-press-bonding portion of the nonwoven sheet and bonding of filaments in an area between adjacent partial-heat-press-bonding portions is weak, and filaments in this area are not fixed, a shape retaining property of a formed part made of this nonwoven sheet is poor and the physical properties of this nonwoven sheet are not good. Further, since this nonwoven sheet has a number of the partial-heat-press-bonding portions, a surface of this nonwoven sheet is not smooth and the printability of this nonwoven sheet is not good.

The same applicant as that of the present application further proposed a nonwoven sheet capable of being used in the forming process by heat-setting a nonwoven sheet composed of undrawn filaments in a preset ratio of shrinkage under a dry heating condition, in Japanese Unexamined Patent Publication (Kokai) No. 60-194159. Though the forming processability of this nonwoven sheet is good, this nonwoven sheet has a poor shape retaining property of a formed part made of this nonwoven sheet, and in physical properties and a flexural endurance property in use. Therefore, this nonwoven sheet cannot be used for a core material.

Under the above-mentioned background, we carried out research with a view to eliminating the problems occurring when the known nonwoven sheets are used as the forming material, and as a result, found that a formable nonwoven sheet having superior forming properties and good utilizability can be obtained by heat treating a nonwoven sheet composed of undrawn filaments of a polyester group, under specific conditions.

SUMMARY OF THE INVENTION

It is a primary object of the present invention to provide a formable nonwoven sheet having superior forming properties and good utilizability.

A second object of the present invention is to provide a method for producing a formable nonwoven sheet having superior forming properties, good physical properties, a smooth surface, and a superior printing capability.

A third object of the present invention is to provide a method for producing a formable nonwoven sheet having superior forming properties, good physical properties, and a good flexural endurance property.

In accordance with the present invention, the first object can be attained by a formable nonwoven sheet composed of filaments of a polyester group and having an apparent density between 0.25 g/cm$^3$ and 0.80 g/cm$^3$ and a breaking elongation at 150° C. of 100% or more, characterized in that a relationship between the value of a hooking resistance Y and the value of a needle piercing resistance X of the formable nonwoven sheet is defined by the following equations (1) or (2).

$$Y/X \geqq 5.00 \quad (1)$$

where $0 < X \leqq 1.2$ $$\frac{Y - 4.5}{X} > 1.25 \quad (2)$$

where $X > 1.2$

The second object of the present invention can be attained by a method for producing a formable nonwoven sheet, wherein a nonwoven web composed of filaments of a polyester group and having a breaking elongation of 100% or more and a birefringence index between $10 \times 10^{-3}$ and $70 \times 10^{-3}$ is formed on a conveyer net by drawing a filament group extruded from spinning nozzles by means of a high speed air current, the nonwoven web is partial-heat-press-bonded by means of a heated embossing roll having a plurality of convex portions, a surface temperature of which is kept between (the second order transition temperature −30° C.) and (the second order transition temperature +30° C.) to make an intermediate nonwoven sheet, and the intermediate nonwoven sheet is heat treated while controlling an area shrinkage of the intermediate nonwoven sheet caused by the heat, by holding the intermediate nonwoven sheet from both sides.

The third object of the present invention can be attained by a method for producing a formable nonwoven sheet, wherein a nonwoven web composed of filaments of a polyester group and having a breaking elongation of 100% or more and a birefringence index between $10 \times 10^{-3}$ and $70 \times 10^{-3}$ is formed on a conveyer net by drawing a filament group extruded from spinning nozzles by means of a high speed air current, the nonwoven web is partial-heat-press-bonded by means of a heated embossing roll having a plurality of convex portions, a surface temperature of which is kept between (the second order transition temperature) and (the second order transition temperature +50° C. ) to make an intermediate nonwoven sheet, and the intermediate nonwoven sheet is heat treated while allowing the intermediate nonwoven sheet to shrink from the heat of steam or boiling water.

BRIEF DESCRIPTION OF THE DRAWINGS

FIG. 4 is a cross sectional view of an example of the formable nonwoven sheet having a smooth surface according to the present invention, wherein

FIG. 7 is a front view illustrating a model forming device, wherein

DESCRIPTION OF THE PREFERRED EMBODIMENTS

Figure 1:
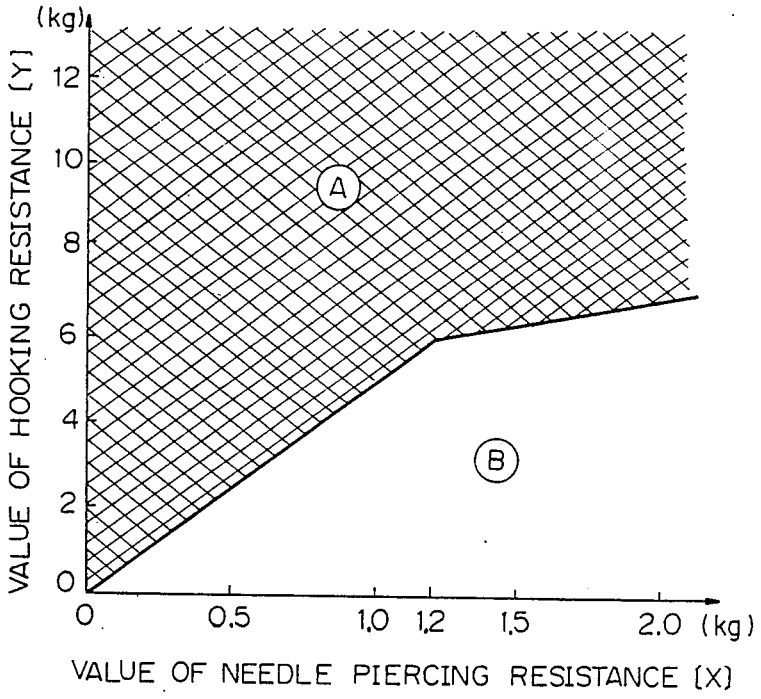
FIG. 1 is a graph illustrating a relationship between a needle piercing resistance value and a hooking resistance value, which relationship expresses a specific characteristic of a formable nonwoven sheet according to the present invention.

A filament of a polyester group used to produce a formable nonwoven sheet according to the present invention can be obtained by spinning a polyester including a straight-chain polyester of 85 mol % derived from a multi basic acid and a polyhydric alcohol (Note, an aromatic polyester e.g., polyethylene terephthalate, and a copolymer thereof are preferable as the polyester).

Conventional additives, e.g. a paint, a pigment, a delustering agent, an antistatic agent, a flame retarder, a reinforced particle or the like may be contained in the polyester. The degree of polymerization is not limited to any particular value, as long as the degree of polymerization is within a range of the usual polymerization degree for producing filaments. Further, a copolymer including a small quantity of another component or a polyester blended with a small quantity of another polymer, e.g., polyamid, olefin or the like, may be used as long as the afore-mentioned objects of the present invention are achieved. A composite filament e.g., a filament having a core and sheath structure or a plied filament produced by composite spinning, may be used. A drawing ratio may be changed as long as the aforementioned objects of the present invention are achieved. The filaments may be produced by plying or mix spinning several polyester filaments having a different denier.

The formable nonwoven sheet according to the present invention may be divided into a nonwoven sheet having a smooth surface (hereinafter, referred to a YP type nonwoven sheet) and a nonwoven sheet having a good flexural endurance property (hereinafter referred to a YR type nonwoven sheet) on the basis of the heat treatment condition during the production of the nonwoven sheet.

Both types of the formable nonwoven sheet according to the present invention have a superior forming property, and this forming property comprises a forming processability and a shape retaining property.

An indispensable condition for obtaining a good forming processability is that an elongation of the filament is large in a certain range of temperature (preferably 120° C. to 200° C.) in a forming process. Therefore, a breaking elongation of the filament at a heating temperature in the forming process, in which the temperature of 150° C. is adopted as a typical temperature, must be 100% or more, preferably between 120% and 300%. When the breaking elongation is large, even if deep concave portions or a complicated shape are formed, the nonwoven sheet can be formed without breakage. Further, to obtain a good fit to a mold and an easy deformation of the nonwoven sheet, preferably the nonwoven sheet has a small shrinkage at the heating temperature, and the stress under an elongation of 30% at a temperature of 150° C. is 50 kg/cm$^2$ or less.

To obtain the good shape retaining property of the formed part, deformation and/or changes in dimension of the formed part at an using temperature must be minimized; the filaments in the nonwoven sheet be closely joined to each other, and a ratio of fixed portions between the filaments to all contacting portions between the filaments be high. Under the above-mentioned background, we carried out research into a method of measuring the ratio of fixed portions, and as a result, found that the ratio of fixed portions can be defined by a relationship between a value of the needle piercing resistance and a value of the hooking resistance.

We now will explain the two above methods as follows.

Value Of Needle Piercing Resistance

Figure 6:
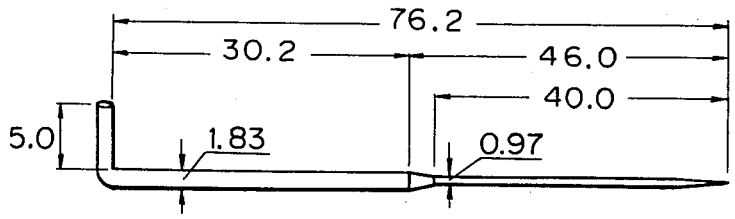
FIG. 6 is a plan view of a felt needle used for a measurement of the value of needle piercing resistance.

This value is defined on the basis of a measurement of a compressive force of the nonwoven sheet by using an AUTO GRAPH DSS-2000 Universal Tensile Tester (Shimazu Seisakusho K.K) under conditions of 24° C. and 55% RH. A felt needle FPG-7, number 20 supplied from Organon Needle K.K (this steel needle is finished in black by a chemical treatment and has a shape as illustrated in FIG. 6) is fixed to a load cell of the tester by a screw. A test piece 3 cm×5 cm is set in a direction perpendicular to the lengthwise direction of the needle in a stretched state. The needle is inserted in the nonwoven sheet of the test piece to a length of 60 m/m from the top of the needle at a speed of 10 cm/min and a maximum value of stress applied on the load cell is measured. The measurement of the stress is repeated three times, and the value of the needle piercing resistance is calculated as an average of the three measured values.

The value of the needle piercing resistance is large when the filaments in the nonwoven sheet are difficult to move, and this value expresses a fixing state of the filaments in a relatively small area of the nonwoven sheet.

Value Of Hooking Resistance

Figure 5:
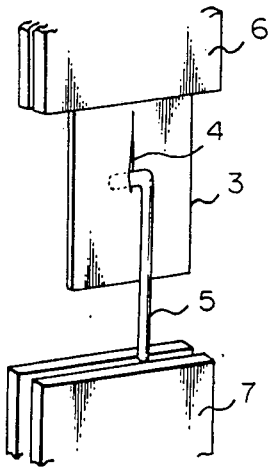
FIG. 5 is a perspective view illustrating a method for measuring the value of the hooking resistance.

This value is measured by the same tester as that used in the measurement of the needle piercing resistance value under conditions of 24° C. and 55% RH. As illustrated in FIG. 5, a test piece 3 cm×10 cm is clamped to an upper chuck 6. A slit 4 having the length of 2 cm in the lengthwise direction of the test piece 4 is arranged on a center portion in the widthwise direction of the test piece 4 within 5 cm to 7 cm from the bottom end of the test piece. A stainless steel hooking tool 5 having a diameter of 2 mm and a length of 10 cm and bent at a right angle 2 cm from one end thereof is clamped to a lower chuck 7 of the tester. In this case, the angled portion of the hooking tool 5 is inserted into the slit 4 of the test piece 3. The tester is operated at a speed of 10 cm/min, and a maximum stress occurring when the chucks 6 and 7 are separated by 10 mm from a point of an initial load is measured. The measurement of the stress is repeated three times and the value of the hooking resistance is calculated as an average of the three measured values. This hooking resistance value expresses a fixing state of the filaments in a relatively large area of the nonwoven sheet.

The formable nonwoven sheet according to the present invention is characterized in that a relationship between the needle piercing resistance value X and the hooking resistance value Y is satisfied by the following equations (1) or (2).

$$Y/X \geqq 5.00 \quad (1)$$

where $0 < X \leqq 1.2$ $$\frac{Y - 4.5}{X} > 1.25 \quad (2)$$

where $X > 1.2$

The above-mentioned relationship is illustrated in FIG. 1, where the needle piercing resistance value is shown by the abscissa and the hooking resistance value is shown by the ordinate. In FIG. 1, the region Ⓐ indicates a region defined as the preferable region in accordance with the present invention, in which region the necessary fixture between the filaments is obtained and a good shape retaining property realized. In the region Ⓑ, the fixture between the filaments is not sufficient.

To form a formed part having a deep concave portion, an apparent density of the nonwoven sheet must be between 0.25 g/cm$^3$ and 0.80 g/cm$^3$, preferably 0.28 ~0.60 g/cm$^3$. When the apparent density is under 0.25 g/cm$^3$, since the ratio of fixture between the filaments in the nonwoven sheet is small, the nonwoven sheet can be easily formed, but the shape retaining property of the formed part produced by using this nonwoven sheet does not satisfy the conditions defined in the above-mentioned equations. When the apparent density is over 0.80 g/cm$^3$, since the filaments in the nonwoven sheet are over-fixed, a strong force for applying deformation to the nonwoven sheet becomes necessary in the forming operation, and fitting of the nonwoven sheet to the mold becomes difficult.

The fineness of filaments used in the nonwoven sheet is preferably between 0.2 denier and 20 denier. When the denier is under 0.2 denier, the mechanical properties of the nonwoven sheet are weak, and when the denier is over 20 denier, the distance between the filaments in the nonwoven sheet are too large.

The weight per unit area of the nonwoven sheet is preferably between 15 g/m$^2$ and 600 g/m$^2$. When this value is under 15 g/m$^2$, since the mechanical strength of the nonwoven sheet is weak, it is impossible to form the formed part having a deep concave portion. When this value is over 600 g/m$^2$, since a strong force must be applied to deform the nonwoven sheet, it is practically difficult to form the formed part having the deep concave portion.

A second characteristic of the nonwoven sheet according to the present invention is that this sheet has a good utilizability.

The average degree of roughness of at least one surface of the YP type formable nonwoven sheet is 100 μm or less, preferably 25 to 70 μm. Therefore this nonwoven sheet has a smooth surface and a good printability, and thus it is possible to print extremely clearly small lettering or marks on the surface of the nonwoven sheet. Note, the small value of the average degree of roughness denotes that the corresponding nonwoven sheet has a smooth surface. When this value is under 25 μm, the surface of the nonwoven sheet becomes film-like, and since the distance between the filaments becomes small, this nonwoven sheet cannot maintain an adequate air permeability and water permeability. When this value is over 100 μm, since there are clear concave or convex portions on the surface of the nonwoven sheet, the printability and an appearance of the nonwoven sheet are not satisfactory.

An abrasion resistance of the YP type nonwoven sheet is good and there is little occurrence of fuzz on the surface.

The more preferable range of the apparent density of the YP type nonwoven sheet is between 0.25 g/cm$^3$ and 0.60 g/cm$^3$.

The YR type nonwoven sheet has a plurality of minute concave portions over the whole surface of the nonwoven sheet. The concave portions, having one area per one concave portion of between 0.01 mm$^2$ and 5.00 mm$^2$, are substantially uniformly distributed on the surface and the area ratio of the total area of the concave portions to the corresponding whole area of the surface is between 5% and 50%. When the area of one concave portion is under 0.01 mm$^2$ and the area ratio is under 5%, peeling between layers in the nonwoven sheet is likely to occur from a repeated bending operation. When the area of one concave portion is over 5.00 mm$^2$, and the area ratio is over 50%, the partial-heat-press-bonded portion exerts a large influence such that the nonwoven sheet will not easily bend and thus the flexural endurance property is unsatisfactory.

An abrasion resistance of the YR type nonwoven sheet is also good and there is little fuzz on the surface.

The more preferable range of the apparent density of the YR type nonwoven sheet is between 0.3 g/cm$^3$ and 0.7 g/cm$^3$.

We will now describe a method for producing the formable nonwoven sheet according to the present invention. The description of the method will be divided into two parts, i.e., the method for producing the YP type nonwoven sheet and the method for producing the YR type nonwoven sheet.

Figure 2:
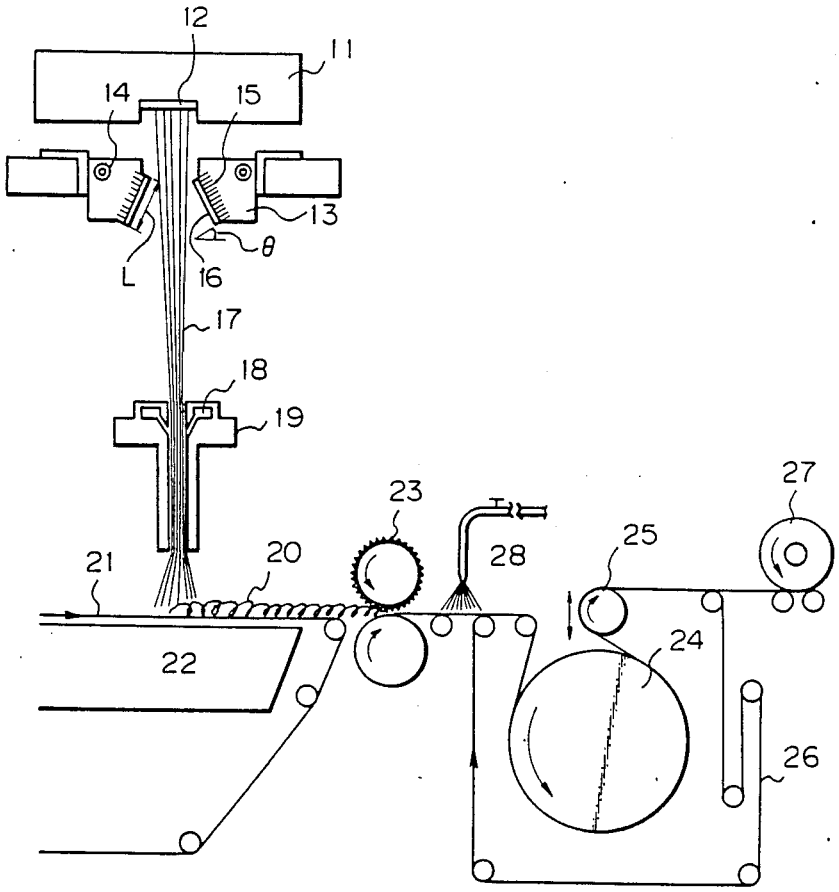
FIG. 2 is a front view illustrating an example of an apparatus for producing a formable nonwoven sheet according to the present invention, in which the nonwoven sheet has a smooth surface.

Production of the YP type nonwoven sheet is performed by using an apparatus illustrated in FIG. 2.

A filaments group 17 extruded from a spinning nozzle 12 arranged on a spin block 11 is cooled by cooling air blown from a cooling air chamber 13 arranged 40 cm directly below the spinning nozzle 13. The cooling air having a temperature of less than 20° C. and blown from a cooling air blow off outlet 16 is supplied through a plurality of current straightening plates 15 toward the filament group 17 by adjusting a blown air angle changing lever 14. The extruded filaments group 17 are drawn by a high speed air current ejected from a pressurized chamber 18 of an air suction device 19, and accumulated on a moving conveyor net 21 provided with an air suction box 22 to make a web 20. In this case, the web composed of polyester filaments having a birefringence index between $10\times10^{-3}$ and $70\times10^{-3}$ 3 and a breaking elongation at 24° C. of 100% or more, is produced by adjusting the quantity of the polymer extruded from the spinning nozzle and the spinning speed operated by the air suction device.

The web is partial-heat-press-bonded by a pair of heated embossing rollers 23, the surface of at least one of these rollers 23 being provided with a plurality of the convex portions. The temperature of the surface of the pair of embossing rollers is kept in the range between (the second order transition temperature of the filaments −30° C.) and (the second order transition temperature of the filaments +30° C. ) and pressure on the pair of heated embossing rollers is between 5 kg/cm$^2$ and 50 kg/cm$^2$. Thus an intermediate nonwoven sheet having an area ratio of partial heat-press-bonding of 5% to 50% is produced.

Next, the intermediate nonwoven sheet is sprayed with water in the range between 1 wt % and 30 wt % for the weight of the corresponding intermediate nonwoven sheet by a spray 28, and then is subjected to a heat treatment in which the intermediate nonwoven sheet is heat treated while controlling an area shrinkage of the intermediate nonwoven sheet caused by the heat by holding the intermediate nonwoven sheet between a felt 26 and a drum 24, the surface temperature of which is kept in the range between (the second order transition temperature of the filaments) and (the melting point of the filament −60 C.). The produced nonwoven sheet is wound by a winding machine 27.

Figure 4A:
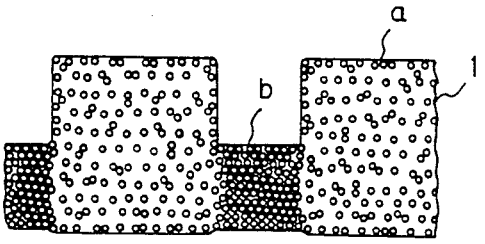
FIG. 4A shows a cross section of an intermediate nonwoven sheet.
Figure 4B:
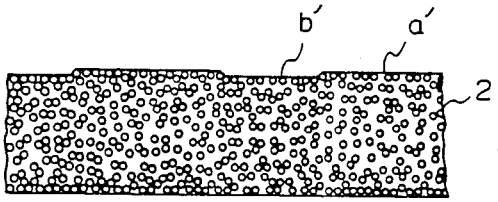
FIG. 4B shows a cross section of a nonwoven sheet after receiving heat treatment.

We will now explain how the surface of the intermediate nonwoven sheet is made smooth by using the above-mentioned manufacturing method, with reference to FIG. 4 illustrating a cross section of the nonwoven sheet. FIG. 4A shows a cross section of the nonwoven sheet partial-heat-press-bonded by means of the pair of heated embossing rollers. Reference a indicates an anti-heat-press-bonded portion, and reference b indicates a heat-press-bonded portion, in which the filaments are joined together. Therefore, the nonwoven sheet illustrated in FIG. 4A has an irregular surface. When the above-mentioned heat treatment is applied to the intermediate nonwoven sheet and the sheet lies between the felt and the drum, since the filaments in the anti-heat-press-bonded portion a are kept under a slight pressure, mutual movement of the filaments, exactly the portion of each filament, in this portion a caused by the heat is restricted, and since the filaments in the heat-press-bonded portion b are not kept between the felt and the drum, the filaments, exactly the portion of each filament, move in various directions. This movement of the portions of filaments is caused by the heat shrinkage of the filament. Since the force bonding the filaments together in the intermediate nonwoven sheet is not strong, the bonding between the filaments in the heat-press-bonded portion b is released by the movement of the portion of filaments, so that the anti-heat-press-bonded portion a and the heat-press-bonded portion b become portions having a nearly equal thickness, as illustrated in FIG. 4B.

Before the intermediate nonwoven sheet is passed through the felt calender, water must be applied to the sheet to achieve the object of the present invention. If necessary, it is preferable to use a surface-active-agent to allow the water to rapidly penetrate the intermediate nonwoven sheet. If water is not applied, an irregular thermal treatment will occur. If over 30 wt % of water is used, a bumping phenomenon and irregularities in the heat treatment occur on the nonwoven sheet, and this causes partial defects in the nonwoven sheet. In the heat treatment, the tension of the felt is adjusted to restrict the intermediate nonwoven sheet, and the thickness of the nonwoven sheet can be adjusted by using a press roller 25.

Preferably, the time of the heat treatment is between 3 sec and 120 sec. If it is under 3 sec, since the heat treatment is not sufficient, residual shrinkage or the like of the nonwoven sheet appears. However it is not recommendable to use a heat treatment of over 120 sec with a view to productivity or the like.

In addition to the felt calender, a rubber belt calender, a steel belt calender or the like may be used as the heat treating apparatus.

Since the YP type nonwoven sheet produced by using the above-mentioned method maintains the largely extendable property of the undrawn filament itself, the forming processability of this nonwoven sheet is superior. Further, since the nonwoven sheet has been heat treated while held between the felt and the drum, a respectable number of the filaments in the nonwoven sheet are fixed, and a good shape retaining property can be obtained. The YP type nonwoven sheet having the superior forming property described hereinbefore can be broadly used as various forming materials. Further, since this nonwoven sheet has a smooth surface, it is possible to raise the grade of the appearance thereof by printing and/or embossing, and this nonwoven sheet can be used in an interior of a car, and as a wall covering, a packaging container or the like.

Figure 3:
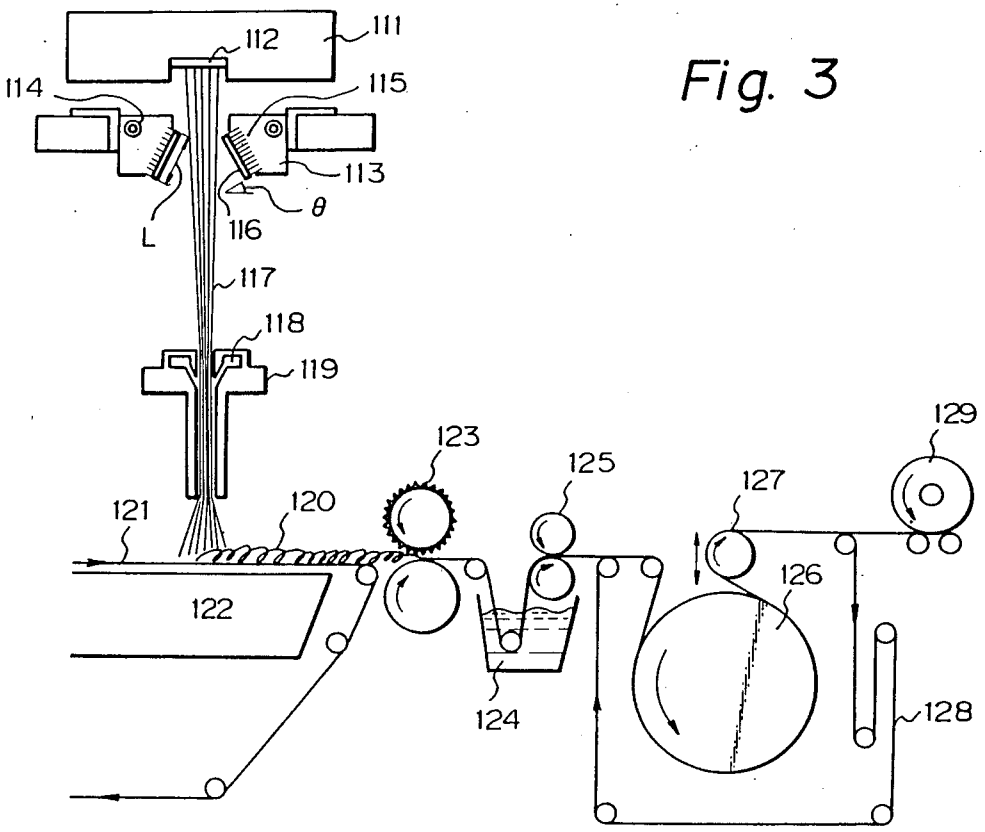
FIG. 3 is a front view illustrating an example of an apparatus for producing a formable nonwoven sheet according to the present invention, in which the nonwoven sheet has a superior flexural endurance property.

Production of the YR type nonwoven sheet is performed by using an apparatus illustrated in FIG. 3. Portions from a spinning nozzle 112 to a conveyer net 121 in the apparatus illustrated in FIG. 3 are the same as that in the apparatus illustrated in FIG. 2. Therefore, same members in FIG. 3 are marked by a corresponding number of the apparatus in FIG. 2 plus a prefix of 100, respectively, and a detailed description of these portions is omitted.

After the web is accumulated on the moving conveyer net 121, the web is partial-heat-press-bonded by a pair of heated embossing rollers 123, a surface of at least one roller being provided with a plurality of convex portions. The temperature of the surface of the pair of the embossing rollers 123 is kept between (the second order transition temperature of the filaments) and (the second order transition temperature of the filaments +50° C.) and pressure exerted on the pair of heated embossing rollers 123 is between 5 kg/cm$^2$ and 50 kg/cm$^2$. Thus an intermediate nonwoven sheet having an area ratio of partial heat-press-bonding between 5% and 50% is produced.

Next, the intermediate nonwoven sheet is shrunk by heat treating with hot water having a temperature of [the second order transition temperature] or more and is dehydrated by a pair of rubber rollers 125. The intermediate nonwoven sheet is then dried while held between a felt 128 and a drum 126, the surface temperature of which is kept between (the second order transition temperature of the filaments) and (the melting point of the filament −60° C.). The produced nonwoven sheet is wound by a winding machine 127. In the drying process, the thickness of the nonwoven sheet can be adjusted by adjusting the tension of the felt 128 and the pressure of the press roller 127. Note, this drying process is only for removing the water from the nonwoven sheet, and the felt calender may be replaced, for example, with a cylinder dryer or the like.

In the method for producing the YR type nonwoven sheet, the heat treatment is performed under a condition in which the intermediate nonwoven sheet can be heat shrunk by using a method of pouring hot water onto the nonwoven sheet, immersing the nonwoven sheet in a hot bath, spraying steam on the nonwoven sheet, and passing the nonwoven sheet through the steam, or the like.

Since the filaments in the nonwoven sheet can be bonded together while in water, to obtain the YR type nonwoven sheet, the nonwoven sheet must be shrunk by a heat treatment in water. Therefore, the YR type nonwoven sheet has a large needle piercing resistance value and a large hooking resistance value and the ratio of fixture of the filaments in the nonwoven sheet becomes high. Further, the heat treatment in water improves the efficiency of the heat conduction of the nonwoven sheet, so that heat shrinkage irregularities can be decreased. On the other hand, if the heat shrinkage process is performed in a dry heat atmosphere, problems such as an inferior heat conduction by the nonwoven sheet, irregular heat shrinkage, low needle piercing resistance value, low hooking resistance value, unsufficient bonding between the filaments, and a low ratio of fixture between the filaments or the like, will occur.

In the heat treatment with heat shrinkage, the extent of the shrinkage can be suitably changed by adjusting the tension while feeding the intermediate nonwoven sheet into a heat shrinking means, or by adjusting the heat treatment time.

Preferably, the condition of the heat treatment is adjusted so that the intermediate nonwoven sheet can shrink to become a shrunken nonwoven sheet having an area between 10% and 60% of the intermediate nonwoven sheet. If this value is under 10%, since the filaments are firmly bonded and the ratio of fixture is large, the mechanical properties of the nonwoven sheet are not good. If this value is over 60%, since the ratio of fixture is small, the abrasion resistance of the nonwoven sheet and the shape retaining property of the formed part are unsatisfactory.

The heat treatment time is preferably in the range between 1 sec and 60 sec. If this time is under 1 sec, the heat treatment is unsufficient. If this time is over 60 sec, the problems of, e.g., low productivity or the like, occur.

The filaments in the YR type nonwoven sheet produced by the above-mentioned method become like undrawn filaments. Namely these filaments have an extremely large breaking elongation at the forming temperature. Therefore, this YR type nonwoven sheet has an extremely large breaking elongation compared with that attained in the known nonwoven sheet at the forming temperature. Thus, the YR type nonwoven sheet can be used as various forming materials capable of being formed as a formed part having a deep concave portion and/or complicated shape. Further since this nonwoven sheet has a plurality of minute concavities and convexities, even if a repeating bending motion is applied to this nonwoven sheet, peeling between layers of the nonwoven sheet does not occur. Therefore, this nonwoven sheet is suitable as a core member for shoes.

Also, as this nonwoven sheet has adequate spacing between the filaments in the sheet, this nonwoven sheet can be broadly used as a formed filter.

With regard to the formable nonwoven sheet including the YP type and the YR type according to the present invention, if necessary a water penetration finishing, a water repellency finishing, an antistatic treatment, a flame retarded finishing or the like can be applied thereto. Further, if printing, embossing, or coloring is applied to the nonwoven sheet, it is possible to increase the grade of the appearance of the nonwoven sheet.

EXAMPLES

The present invention will be described with reference to preferred examples, including examples of the YP type nonwoven sheets, i.e., example group A to C, and examples of the YR type nonwoven sheets, i.e., example group D and E.

Since the present invention concerns novel nonwoven sheets having specific characteristics determined by special measurements, it may be helpful at this point to describe and define various characteristics and measurements that are used throughout this specification except the characteristics "Hooking Resistance" and "Needle Piercing Resistance" described and defined hereinbefore.

Apparent Density (based on JIS-L-1096):

A test piece 20 cm×20 cm is weighed, the weight per unit area is calculated, and the thickness is measured by using a dial gauge having a measuring element 10 mm $\phi$ in diameter and weighing 80 g. The weight per unit volume is calculated from the above-mentioned weight and thickness, and the apparent density is expressed by the obtained value.

Birefringence Index:

The birefringence Index is measured by using an interference microscope (Berek Compensator) under a white light.

Strength and Elongation (based on JIS-L-1096):

The strength and elongation are measured at a grip length of 10 cm and a pulling speed of 20 m/min by using a universal tensile tester (Auto-Graph Model DSS-2000 supplied by Shimazu Seisakusho).

Stress under Elongation of 30%:

The stress under elongation of 30% is expressed by the value dividing the strength under the elongation of 30% by the cross-sectional area of the test piece. When the stress under elongation of 30% of the thread is measured, an initial load of 0.1 g/d is used.

Air Permeability (based on JIS-L-1096):

The air permeability is measured by using a Frazier permeometer.

Abrasion Resistance (based on JIS-L-0823):

A test piece 20 cm (length)×3 cm (width) is abraded 100 times reciprocatively under a load of 500 g by an abrasion tester model II (Gakushin type), and the change of the appearance is examined and evaluated as an abrasion resistance according to the following scale.

Grade A: no fluff

Grade B: some fluff but not conspicuous

Grade C: conspicuous fluff

Average degree of Roughness:

The difference between the respective means of maximum peak values and minimum peak values obtained from surface roughness charts obtained through the measurement of the surface roughness of sample pieces by using SURFCOM 200B (Tokyo Seimitsu K.K.), a measuring instrument specified in JIS B 0651-76.

Flexural Endurance Ratio:

A test piece 2.5 cm×15 cm is flexed reciprocatively at a stroke of 8 cm by an compression bending tester supplied by Kamishima Seisakusho; the distance between an upper gripping member and a lower gripping member being 10 cm. The flexural endurance ratio is calculated from the following equation.

$$\text{Flexural Endurance Ratio} = TB/TA \times 100$$

where TA is the tensile strength of the untreated test piece, and TB is the tensile strength of the test piece treated by the flexing operation.

Heat Deterioration:

Test pieces are treated at 105° C. for 300 hours in a hot air drier. The breaking elongation of test pieces treated by the hot air is compared with the breaking elongation of untreated test pieces, and the heat deterioration is calculated from the following equation.

$$\text{Heat Deterioration} = L_1/L_0 \times 100$$

where $L_0$ is the breaking elongation of the untreated test piece, and $L_1$ is the breaking elongation of the test piece treated by hot air.

Area Enlarging Ratio of the Nonwoven Sheet:

This characteristic denotes an enlarging degree of the corresponding area of the nonwoven sheet when a forming operation is applied to the nonwoven sheet, and is calculated from the following equation.

$$\text{Area Enlarging Ratio} = S_1/S_0$$

where S is an area of the nonwoven sheet to be formed and $S_1$ is an enlarged area corresponding to S of the nonwoven sheet after the forming operation is applied.

Difference of the Weight per Unit Area between Side Portion and Bottom Portion of the Formed Part:

Each test piece is cut from the side portion and the bottom portion of the nonwoven sheet constituting the formed part and each weight per unit area is measured. This characteristic is calculated from the following equation.

$$\text{Difference of the Weight per unit area between side and bottom} = \frac{a \times 100}{a+b} - \frac{b \times 100}{a+b}$$

where a is the weight per unit area in the side portion and b is the weight per unit area in the bottom portion.

Heat Resistance of the Formed Part:

A formed part to be tested is immersed for 5 minutes in boiling water and difference of the dimension between an untreated formed part and a formed part immersed in boiling water is measured, and the heat resistance of the formed part is expressed by the obtained value.

Figure 7A:
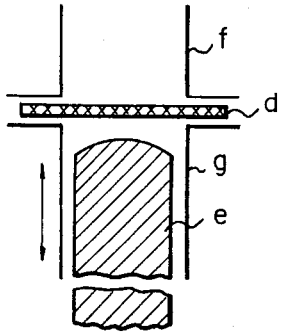
FIG. 7A shows the device before a heating body is inserted.
Figure 7B:
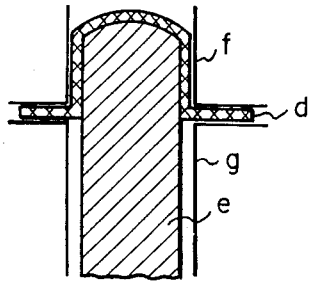
FIG. 7B shows the device after the heating body is inserted; and, FIG. 8 is a cross-sectional view of a formed part obtained by using the forming device illustrated in FIG. 7.
Figure 8:
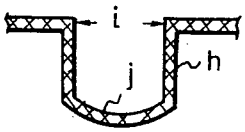

Shape Retaining Property of the Formed Part against an Eternal Force:

A formed part having a shape illustrated in FIG. 8 is formed form the nonwoven sheet by using a forming device illustrated in FIG. 7. A load of 100 g is exerted on the formed part. The shape retaining property of the formed part is evaluated according to the following scale.

⊙ : not deformed o : slightly deformed, but when the load is removed, the formed part recovers its original shape.

Δ: largely deformed, and even if the load is removed, the formed part does not recover its original shape.

x: crushed. After the load is removed, shape remains crushed.

Method for forming the formed part from the nonwoven sheet:

As illustrated in FIG. 7A, a heating body ⓔ having a columnar shape, a top end of which is rounded, and capable of moving in an upper direction and a lower direction is accommodated in a cylinder ⓕ and a cylinder ⓖ. The nonwoven sheet ⓓ according to the present invention is fixed between the cylinder ⓕ and the cylinder ⓖ is formed by using the heating body ⓔ heated 90° C.~200° C. as illustrated in FIG. 7B. Since the nonwoven sheet according to the present invention is capable of easily spreading when heated, when the nonwoven sheet ⓓ is heated by the heating body ⓔ raised upward and coming into contact with the nonwoven sheet ⓓ to be deformed, the heating body ⓔ can be easily inserted into the cylinder ⓕ with the nonwoven sheet ⓓ. Accordingly, the nonwoven sheet ⓓ is formed to make a formed part as illustrated in FIG. 7B. The fibers constituting the nonwoven sheet according to the present invention are uniformly elongated by heating when the formed part is produced. Consequently, a difference between mean values of the weight per unit area of the nonwoven sheet in a side portion ⓗ and a bottom portion ⓙ of the formed part as illustrated in FIG. 8 is very low. It is possible to make the above-mentioned difference of the mean values of the weight per unit area under 50%. If a condition of the forming process is suitably selected, it is possible to make the above-mentioned difference under 30%.

EXAMPLE GROUP A

A polyethylene terephthalate having an intrinsic viscosity of 0.75 and including 0.5% of $TiO_2$ is extruded at a temperature of 295° C. and an extruding rate of 1000 g/min by means of a rectangular spinning nozzle having 1000 holes with a diameter of 0.25 mm. A filament group extruded from the spinning nozzle is drawn by a high speed air current ejected from an air suction device arranged 850 mm directly below the spinning nozzle and accumulated on a conveyer net to make a web having a weight per unit area of 150 g/m$^2$. In this case, various filaments are produced by changing the spinning speed. Two type of webs are produced, i.e., one type of web is produced by using a cooling air having a temperature of 10° C. and blown from a cooling chamber arranged on both sides of the filament group as illustrated in FIG. 2, and another type of web is produced without the cooling air. In this example group, the length L of the cooling air blowing out zone is 70 mm, the blowing angle $\theta$ is 35° C., and the speed of the cooling air is 0.8 m/sec.

The web is partial-heat-press-bonded by a heated embossing unit arranged downstream of the conveyer net and constituted with a top roller having a convex and concave pattern on a surface thereof and a bottom roller having a smooth surface, to make an intermediate nonwoven sheet. The unit area of the convex portion of the top embossing roller is 2 mm$^2$, the area ratio of partial-heat-press-bonding is 24%, the surface temperature of the top embossing roller and the bottom smooth roller is 80° C., and a line pressure between the top embossing roller and the bottom embossing roller is 20 kg/cm. The intermediate nonwoven sheet is uniformly sprayed with water at 3 weight % and is subjected to a heat treatment at a speed of 15 m/min by using a felt calender having a drum with a diameter of 1800 mm and heated at 130° C. The properties of examples of the nonwoven sheet produced by the above-mentioned process and the properties of reference examples are shown in Table 1.

The nonwoven sheet of reference example 5 is the nonwoven sheet partial-heat-press-bonded by using the top embossing roller having a temperature of 235° C., because this nonwoven sheet cannot be heat-press-bonded at 80° C. The nonwoven sheet of the reference example 6 is produced by using the same intermediate nonwoven sheet as the intermediate nonwoven sheet used in example 3 and by applying a heat treatment under a stretched state for 30 sec by a pin stenter having a temperature of 180° C.

As shown in Table 1, the YP type nonwoven sheet according to the present invention of examples 1 to 3 has a good forming processability, due to the large breaking elongation at 150° C. and the superior shape retaining property due to the value of the hooking resistance Y divided by the needle piercing resistance value X (hereinafter, referred to as "ratio of Y to X") of 5.0 or more in the range of the needle piercing resistance of less than 1.2 kg and that the ratio of filaments fixed each other in the nonwoven sheet become large. Further, these nonwoven sheets have good properties in the smoothness of the surface, the abrasion resistance, and the heat deterioration, and have an adequate air permeability. These nonwoven sheets can be uniformly formed as a formed part having an enlarged portion of up to about four times that of the corresponding original portion and the obtained formed part has a good heat resistance and good shape retaining property.

The nonwoven sheet of reference example 4 is easily deteriorated by heat, and therefore the forming temperature must be limited to a narrow range.

The nonwoven sheet of reference example 5 has a small breaking elongation at 150° C., a ratio of Y to X of less than 5.0, a poor average degree of roughness of 100 μm or more, and an inferior abrasion resistance.

The nonwoven sheet of reference example 6 has a good forming processability due to a large breaking elongation at 150° C., so that the nonwoven sheet can be uniformly formed as a formed part having an enlarged portion of up to about three times that of the corresponding original portion. However, since the ratio of Y to X is less than 5.0 at a needle piercing resistance of less than 1.2 kg the shape retaining property becomes poor. Further, the abrasion resistance and the smoothness of the surface of this nonwoven sheet are unsatisfactory.

It is apparent from Table 1 that the YP type nonwoven sheets according to the present invention of examples 1 to 3 are formable nonwoven sheets having the forming property and the utilizability that will satisfy the object of the present invention, but the nonwoven sheets of the reference examples 4 to 6 have an inferior forming property and utilizability, respectively.

TABLE 1

| | | Example | | | Reference Example | | |
|---|---|---|---|---|---|---|---|
| | | 1 | 2 | 3 | 4 | 5 | 6 |
| Condition for | Spinning Speed (m/min) | 1900 | 2500 | 2500 | 1200 | 5200 | 2500 |

TABLE 1-continued

| | | Example | | | Reference Example | | |
|---|---|---|---|---|---|---|---|
| | | 1 | 2 | 3 | 4 | 5 | 6 |
| Producing Nonwoven Web | Cooling Air | not used | not used | used | not used | not used | used |
| Fiber Properties in Nonwoven Web arranged in Conveyer Net | Birefringence Index Δn (× $10^{-3}$) | 18 | 28 | 29 | 8 | 103 | 29 |
| | Breaking Strength (g/d) | 1.3 | 1.7 | 1.8 | 0.7 | 3.3 | 1.8 |
| | Breaking Elongation (%) | 310 | 260 | 250 | 440 | 75 | 250 |
| | Fineness (denier) | 4.3 | 3.2 | 3.1 | 6.2 | 1.3 | 3.1 |
| Properties of Nonwoven Sheet | Apparent Density (g/cm$^3$) | 0.32 | 0.28 | 0.27 | 0.34 | 0.19 | 0.24 |
| | Breaking Elongation at 150° C. (%) | 255/230 | 225/210 | 210/195 | 75/110 | 35/40 | 160/150 |
| | Stress under Elongation at 30% at 150° C. (kg/cm$^2$) | 13/9 | 21/16 | 23/18 | 8/5 | 128/79 | 26/20 |
| | Needle Piercing Resistance [X] (kg) | 0.78 | 0.73 | 0.76 | 1.16 | 1.23 | 1.16 |
| | Hooking Resistance [Y] (kg) | 7.6 | 6.7 | 6.5 | 5.2 | 4.6 | 4.9 |
| | [Y]/[X] | 9.7 | 9.2 | 8.6 | 4.5 | 3.6 | 4.2 |
| | $\frac{[Y] - 4.5}{[X]}$ | 4.0 | 3.0 | 2.6 | 0.6 | 0.1 | 0.3 |
| | Average degree of Roughness (μm) | 41 | 50 | 53 | 30 | 230 | 186 |
| | Air Permeability (cc/cm$^2$/sec) | 38 | 45 | 47 | 33 | 41 | 61 |
| | Abrasion Resistance (degree) | A | A | A | A | B | B |
| | Heat Deterioration (%) | 65/61 | 76/72 | 93/90 | 25/23 | 98/97 | 91/92 |
| Properties of Formed Part | Area Enlarging Ratio | 4.5 | 4.2 | 4.1 | — | 1.4 | 2.7 |
| | Difference of the Weight per Unit Area between Side and Bottom (%) | 5 | 7 | 8 | — | — | 14 |
| | Heat Resistance | 2 | 1 | 1 | — | 1 | 1 |
| | Shape Retention | ◎ | o | o | — | x | Δ |

Note:
A/B in Table express that A is a value in lengthwise direction of Nonwoven Sheet and B is same in widthwise direction.

EXAMPLE GROUP B

In this example group B, the intermediate nonwoven sheet of example 3 in the example group A described hereinbefore is used as the intermediate nonwoven sheets of the various examples, and various YP type nonwoven sheets are produced by changing the condition of the heat treatment, e.g., water content, temperature, line pressure of the pressure roller or the like.

The properties of the examples of the YP type nonwoven sheet belonging this example group B and the conditions necessary to produce those nonwoven sheets are shown in Table 2.

As shown in Table 2, the YP type nonwoven sheet of examples 7 to 12 have a good forming processability due to a large breaking elongation at 150° C., so that the nonwoven sheet can be uniformly formed to a formed part having an enlarged portion of up to about four times that of the corresponding original portion. The ratio of Y to X becomes large according to the water content increase from 3 to 25%, and a ratio of filaments fixed to each other to all filaments is increased, so that the average degree of roughness becomes small and the surface of the nonwoven sheet become smoother. Therefore, the nonwoven sheet of examples 7 to 12, is a formable nonwoven sheet having a forming property and the utilizability which can sufficiently satisfy the object of the present invention.

The nonwoven sheet of reference example 13 is produced by using an extremely increased water content. In this case, a uniform heat treatment of the nonwoven sheet cannot be carried out due to the boiling of the water in an inlet of the drum, so that an inferior dispersion of the filaments caused by an irregular heat shrinkage of the filaments occurs. Therefore, the appearance of this nonwoven sheet becomes inferior.

On the basis of this result of the example group B, it is apparent that, to obtain the smooth surface, good forming property and excellent utilizability of the nonwoven sheet, an adequate quantity of the water must be applied to the nonwoven sheet.

TABLE 2

| | | Example | | | | | | Reference Example |
|---|---|---|---|---|---|---|---|---|
| | | 7 | 8 | 9 | 10 | 11 | 12 | 13 |
| Condition of Heat Treatment in Felt Calender | Number of Heat Treatment | 1 (One side) | | | | | 2 (Both side) | 1 (One side) |
| | Water Content in Intermediate Nonwoven sheet (wt %) | 3 | 10 | 25 | 3 | 3 | 3 | 67 |
| | Temperature of Felt Drum (°C.) | 130 | 130 | 130 | 130 | 180 | 130 | 130 |
| | Pressure of Press Roll | 10 | 10 | 10 | 20 | 20 | 20 | 10 |
| Properties of Nonwoven Sheet | Apparent Density (g/cm$^3$) | 0.29 | 0.30 | 0.30 | 0.30 | 0.32 | 0.34 | 0.30 |
| | Breaking Elongation at 150° C. (%) | 203/190 | 199/187 | 196/188 | 198/192 | 183/180 | 176/172 | 195/194 |
| | Stress under Elongation of 30% at 150° C. (kg)cm$^2$) | 25/20 | 27/22 | 28/24 | 27/22 | 30/25 | 29/24 | 27/25 |
| | Needle Piercing Resistance [X] (kg) | 0.74 | 0.73 | 0.72 | 0.71 | 0.70 | 0.70 | 1.16 |
| | Hooking Resistance [Y] (kg) | 6.7 | 6.8 | 6.9 | 6.6 | 6.9 | 7.3 | 5.1 |
| | [Y]/[X] | 9.1 | 9.3 | 9.6 | 9.3 | 9.9 | 10.4 | 4.4 |

TABLE 2-continued

| | | Example | | | | | | Reference Example |
|---|---|---|---|---|---|---|---|---|
| | | 7 | 8 | 9 | 10 | 11 | 12 | 13 |
| | $\frac{[Y]-4.5}{[X]}$ | 3.0 | 3.2 | 3.3 | 3.0 | 3.4 | 4.0 | 0.5 |
| | Average degree of Roughness (μm) | 50 | 48 | 48 | 48 | 42 | 41 | 56 |
| | Air Permeability (cc/cm²/sec) | 45 | 43 | 43 | 43 | 41 | 38 | 52 |
| | Abrasion Resistance (degree) | A | A | A | A | A | A | B |
| | Heat Deterioration (%) | 92/90 | 91/89 | 91/89 | 93/91 | 94/92 | 93/91 | 91/90 |
| Properties of Formed Part | Area Enlarging Ratio | 4.0 | 4.1 | 4.1 | 3.9 | 3.8 | 3.6 | 3.7 |
| | Difference of the Weight per Unit Area between Side and Bottom (%) | 9 | 8 | 8 | 9 | 10 | 11 | 15 |
| | Heat Resistance | 1 | 1 | 1 | 1 | 1 | 2 | 2 |
| | Shape Retention | o | o | o | o | o | o | o |

Note:
A/B in Table express that A is a value in lengthwise direction of NonwovenSheet and B is same in widthwise direction.

EXAMPLE GROUP C

Intermediate nonwoven sheets belonging to this example group C are produced by a method similar to the method used in the production of the nonwoven sheets belonging to example group A. In this example group C, two examples of the YP type nonwoven sheets and one reference example having a weight per unit area of 250 g/m² (in the example groups A and B, the nonwoven sheets having a weight per unit area of 150 g/m² are used), respectively, and produced by using partial-heat-press-bonding condition, e.g., the temperature of the top embossing roller, different from the example groups A and B, are prepared.

Namely, a polyethylene terephthalate having an intrinsic viscosity of 0.75 and including a $Tio_2$ of 0.5% is extruded at a temperature of 295° C. and an extruding rate of 1000 g/min by means of a rectangular spinning nozzle having 1000 holes with a diameter of 0.25 mm. A filament group extruded from the spinning nozzle is drawn by a high speed air current ejected from an air suction device arranged 800 mm directly below the spinning nozzle and accumulated on a conveyer net to make a web having a weight per unit area of 250 g/m².

The web is partial-heat-press-bonded by means of a heated embossing unit arranged downstream of the conveyer net and having substantially the same construction as that of the embossing unit used in the example groups A and B, to make the intermediate nonwoven sheet. The conditions in example group C that differ from those in example groups A and B are as follows;

The area ratio of partial-heat-press-bonding is 33%,

The surface temperature of the top embossing roller and the bottom embossing roller is 65° C., The line pressure between the top embossing roller and the bottom embossing roller is 35 kg/cm, The quantity of water used for spraying is 5 wt %, The speed of processing the nonwoven sheet is 13 m/min.

The properties of the examples of the YP type nonwoven sheet belonging to this example group C and the conditions necessary to produce these nonwoven sheets are shown in Table 3.

As shown in Table 3, the YP type nonwoven sheet of examples 14 and 15 have a good forming processability due to a large breaking elongation at 150° C., so that the nonwoven sheet can be uniformly formed as a formed part having an enlarged portion of up to about four times that of the corresponding original portion. The value of the equation $$\frac{Y-4.5}{X} \text{ is } 1.25$$

or more in the range of the needle piercing resistance of over 1.2 kg and the ratio of filament fixed together in the nonwoven sheet become large, so that a superior shape retaining property of the formed part can be obtained. Further, these nonwoven sheets have good properties in the smoothness of the surface and the abrasion resistance, and have an adequate air permeability.

The nonwoven sheet of reference example 16 is easily deteriorated by heat, as in the reference example 4 in example group A, and therefore, the forming temperature must be limited to a narrow range.

The nonwoven sheets of examples 14 and 15 are the formable nonwoven sheets having a forming property and utilizability that satisfies the object of the present invention.

TABLE 3

| | | Example | | Reference Example |
|---|---|---|---|---|
| | | 14 | 15 | 16 |
| Condition for Producing Nonwoven Web | Spinning Speed (m/min) | 1900 | 2500 | 1200 |
| | Cooling Air | not used | not used | not used |
| Fiber Properties in Nonwoven Web arranged in Conveyer Net | Birefringence Index Δn (× $10^{-3}$) | 18 | 28 | 8 |
| | Breaking Strength (g/d) | 1.3 | 1.7 | 0.7 |
| | Breaking Elongation (%) | 310 | 260 | 440 |
| | Fineness (denier) | 4.3 | 3.2 | 3.1 |
| Properties of Nonwoven Sheet | Apparent Density (g/cm³) | 0.30 | 0.26 | 0.25 |
| | Breaking Elongation at 150° C. (%) | 245/233 | 217/214 | 82/115 |
| | Stress under Elongation at 30% at 150° C. (kg/cm²) | 12/10 | 19/17 | 7/6 |
| | Needle Piercing Resistance [X] (kg) | 1.33 | 1.25 | 0.94 |
| | Hooking Resistance [Y] (kg) | 10.3 | 9.6 | 5.2 |
| | [Y]/[X] | 7.7 | 8.4 | 5.5 |

TABLE 3-continued

| | | Example 14 | Example 15 | Reference Example 16 |
|---|---|---|---|---|
| | $\frac{[Y] - 4.5}{[X]}$ | 4.4 | 4.1 | 0.7 |
| | Average degree of Roughness (μm) | 32 | 40 | 26 |
| | Air Permeability (cc/cm²/sec) | 36 | 43 | 30 |
| | Abrasion Resistance (degree) | A | A | A |
| | Heat Deterioration (%) | 66/65 | 78/75 | 26/25 |
| Properties of Formed Part | Area Enlarging Ratio | 4.5 | 4.1 | — |
| | Difference of the Weight per Unit Area between Side and Bottom (%) | 5 | 7 | — |
| | Heat Resistance | 2 | 1 | — |
| | Shape Retention | ◎ | ◎ | — |

Note:
A/B in Table express that A is a value in lenghtwise direction of Nonwoven Sheet and B is same in widthwise direction.

EXAMPLE GROUP D

In this example group D, five examples of the YR type nonwoven sheet according to the present invention, and three reference examples thereof, are described.

A polyethylene terephthalate having an instrinsic viscosity of 0.75 and including a $TiO_2$ of 0.5% is extruded at a temperature of 295° C. and an extruding rate of 1000 g/min by means of a rectangular spinning nozzle having 1000 holes with a diameter of 0.25 mm. A filament group extruded from the spinning nozzle is drawn by a high speed air current ejected from an air suction device arranged 800 mm directly below the spinning nozzle and accumulated on a conveyer net to make a web having a weight per unit area of 150 g/m². In this case, various filaments are produced by changing the spinning speed. Two types of webs are produced, i.e., one type of web is produced by using a cooling air having a temperature of 10° C. and blown from a cooling chamber arranged on both sides of the filament group, as illustrated in FIG. 3. In this example group, the length L of the cooling air blowing out zone is 70mm, the blowing angle $\theta$ is 35°, and the speed of the cooling air is 0.8 m/sec.

The web is partial-heat-press-bonded by means of a heated embossing unit arranged downstream of the conveyer net and constituted with a top roller having a convex and concave pattern on a surface thereof and a bottom roller having a smooth surface, to make an intermediate nonwoven sheet. A unit area of the convex portion of the top embossing roller is 2 mm², an area ratio of partial-heat-press-bonding is 14%, a surface temperature of the top embossing roller and the bottom smooth roller is 90° C., and a line pressure between the top embossing roller and the bottom smooth roller is 30 kg/cm.

Next, the intermediate nonwoven sheet is immersed into a hot water bath having a temperature of 85° C. while an overfeeding of the intermediate nonwoven sheet is maintained at 35% by adjusting a tension of the intermediate nonwoven sheet and a speed for feeding the intermediate nonwoven sheet into the hot water bath. The intermediate nonwoven sheet shrunk in the hot water bath is squeezed by a pair of rubber rollers to remove water and is dried at the speed of 5 M/min by using a felt calender having a drum with a diameter of 1800 mm and heated at 130° C.

The nonwoven sheet of reference example 23 is the nonwoven sheet partial-heat-press-bonded by using the top embossing roller having a temperature of 235° C., because this nonwoven sheet cannot be heat-press-bonded at 90° C. The nonwoven sheet of reference example 24 is produced by using the same intermediate nonwoven sheet as the intermediate nonwoven sheet used in example 18, and by applying a dry heat treatment while shrinking by 30% in the lengthwise direction and 35% in the widthwise direction for 30 sec by means of a pin stentor.

The properties of examples of the nonwoven sheet produced by the above-mentioned process and the properties of reference examples are shown in Table 4.

As shown in Table 4, the YR type nonwoven sheet according to the present invention of examples 17 to 21 have a good forming processability due to an extremely large breaking elongation at 150° C., so that the nonwoven sheet can be uniformly formed as a formed part having an enlarged portion of up to about five or six times that of the corresponding original portion. Since the value of the equation $$\frac{Y - 4.5}{X} \text{ is } 1.25$$

or more in the range of the needle piercing resistance of over 1.2 kg, the shape retaining property of the formed part is extremely excellent. Further, with regard to the utilizability of the nonwoven sheet, these nonwoven sheets have a good abrasion resistance, a flexural endurance property capable of enduring a repeated flexural operation, and an adequate air permeability.

The nonwoven sheet of reference example 22 is easily deteriorated by heat, therefore the forming temperature must be limited to a narrow range.

The nonwoven sheet of reference example 23 is not shrunk by heat and there is no change in characteristics caused by heat treatment. Therefor, the breaking elongation at 150° C. of this nonwoven sheet is small and the forming processability is unsatisfactory. Further, since the value of the equation $$\frac{Y - 4.5}{X}$$

in the range of the needle piercing resistance of over 1.2 kg is small, the shape retaining property is unsatisfactory.

Since the nonwoven sheet of the reference example 24 has a large breaking elongation at 150° C., this nonwoven sheet can be formed as a formed part having an enlarged portion of up to about three times that of the corresponding original portion. However, since the value of the equation $$\frac{Y - 4.5}{X}$$

is less than 1.25 in the range of the needle piercing resistance of over 1.2 kg, the shape retaining property of this nonwoven sheet is inferior and the abrasion resistance is unsatisfactory.

It is apparent from Table 4 that the YR type nonwoven sheets according to the present invention of examples 17 to 21 are formable nonwoven sheets having a forming property and utilizability that satisfies the object of the present invention, but the nonwoven sheets of reference examples 22 to 24 have an inferior forming property and utilizability, respectively.

TABLE 4

| | | Example | | | | | Reference Example | | |
|---|---|---|---|---|---|---|---|---|---|
| | | 17 | 18 | 19 | 20 | 21 | 22 | 23 | 24 |
| Condition for Producing Nonwoven Web | Spinning Speed (m/min) | 1900 | 2400 | 3000 | 2400 | 3000 | 1200 | 5200 | 2400 |
| | Cooling Air | not used | not used | not used | used | used | not used | not used | not used |
| Fiber Properties in Nonwoven Web arranged on Conveyer Net | Birefringence Index $\Delta n$ ($\times 10^{-3}$) | 16 | 24 | 38 | 25 | 37 | 8 | 103 | 24 |
| | Breaking Strength (g/d) | 1.1 | 1.5 | 2.0 | 1.6 | 2.1 | 0.7 | 3.3 | 1.5 |
| | Breaking Elongation (%) | 330 | 275 | 210 | 270 | 205 | 440 | 75 | 275 |
| | Fineness (denier) | 4.5 | 3.4 | 2.8 | 3.5 | 2.8 | 6.2 | 1.3 | 3.4 |
| Properties of Nonwoven Sheet | Weight per Unit Area (g/cm$^2$) | 415 | 380 | 350 | 375 | 345 | 405 | 150 | 330 |
| | Apparent Density (g/cm$^3$) | 0.52 | 0.44 | 0.35 | 0.43 | 0.33 | 0.45 | 0.19 | 0.36 |
| | Breaking Elongation at 150° C. (%) | 410/380 | 370/340 | 310/270 | 350/330 | 300/260 | 110/130 | 35/45 | 260/240 |
| | Stress under Elongation at 30% at 150° C. (kg/cm$^2$) | 9/7 | 11/9 | 15/11 | 12/9 | 16/12 | 7/4 | 128/79 | 15/13 |
| | Needle Piercing Resistance [X] (kg) | 1.58 | 1.53 | 1.38 | 1.51 | 1.35 | 1.20 | 1.23 | 1.22 |
| | Hooking Resistance [Y] (kg) | 9.8 | 9.2 | 9.0 | 9.0 | 8.8 | 5.4 | 4.6 | 5.3 |
| | [Y]/[X] | 6.2 | 6.0 | 6.5 | 6.0 | 6.5 | 4.5 | 3.6 | 4.3 |
| | $\frac{[Y] - 4.5}{[X]}$ | 3.4 | 3.1 | 3.3 | 3.0 | 3.2 | 0.8 | 0.1 | 0.7 |
| | Flexural Endurance Ratio (%) | 91/90 | 92/90 | 88/87 | 92/91 | 87/86 | 46/43 | 95/93 | 67/64 |
| | Air Permeability (cc/cm$^2$/sec) | 6 | 7 | 12 | 8 | 14 | 8 | 41 | 21 |
| | Abrasion Resistance (degree) | A | A | A | A | A | A | B | B |
| | Heat Deterioration (%) | 68/66 | 77/75 | 83/80 | 85/90 | 91/90 | 25/23 | 98/97 | 80/78 |
| Properties of Formed Part | Area Enlarging Ratio | 6.1 | 5.8 | 5.2 | 5.6 | 5.1 | — | 1.4 | 3.5 |
| | Difference of the Weight per Unit Area between Side and Bottom (%) | 7 | 8 | 10 | 7 | 9 | — | 5 | 11 |
| | Heat Resistance | 2 | 2 | 1 | 2 | 1 | — | 1 | 2 |
| | Shape Retention | ◉ | ◉ | o | ◉ | o | — | x | Δ |

Note:
A/B in Table express that A is a value in lengthwise direction of Nonwoven Sheet and B is same in widthwise direction.

EXAMPLE GROUP E

In this example group E, the same intermediate nonwoven sheet as the intermediate nonwoven sheet in example group D is used, and various YR type nonwoven sheets are produced by changing the weight per unit area and the heat treatment conditions.

A polyethylene terephthalate having an intrinsic viscosity of 0.75 and including a $TiO_2$ of 0.5% is extruded at a temperature of 295° C. and an extruding rate of 1000 g/min by means of a rectangular spinning nozzle having 1000 holes with a diameter of 0.25 mm. A filament group extruded from the spinning nozzle is drawn by a high speed air current ejected from an air suction device arranged 800 mm directly below the spinning nozzle and accumulated on a conveyor net to make a web having a weight per unit area of 250 g/m$^2$.

The web is partial-heat-press-bonded by means of a heated embossing unit arranged downstream of the conveyor net and constituted with a top roller having a convex and concave pattern on a surface thereof and a bottom roller having a smooth surface to make an intermediate nonwoven sheet. A unit area of the convex portion of the top embossing roller is 2 mm$^2$, an area ratio of partial-heat-press-bonding is 14%, a surface temperature of the top embossing roller and the bottom embossing roller is 95° C., and a line pressure between the top embossing roller and the bottom embossing roller is 30 kg/cm$^2$.

Next, the intermediate nonwoven sheet is immersed in a hot water bath while adjusting a tension of the intermediate nonwoven sheet to satisfy a preset area ratio defined as follows.

$$\text{Preset Area Ratio} = \frac{\text{Area of nonwoven sheet after heat treatment}}{\text{Area of nonwoven sheet before heat treatment}} \times 100$$

The properties of the examples of the YR type nonwoven sheet belonging to this example group E, and the conditions necessary to produce these nonwoven sheets, are shown in Table 5.

As shown in Table 5, the YR type nonwoven sheet of examples 25 to 27 have a good forming processability due to an extremely high breaking elongation at 150° C., so that the nonwoven sheet can be formed as a formed part having an enlarged portion of up to about five times that of the corresponding original portion. Since the value of the equation $$\frac{Y-4.5}{X} \text{ is } 1.25$$

or more in the range of the needle piercing resistance of over 1.2 kg, the shape retaining property of the formed part is superior. When the value of the preset area ratio is made smaller, so that the heat shrinkage of the nonwoven sheet becomes large, the forming processability and the shape retaining property become very good.

While since the nonwoven sheet of the reference example 28 is produced while having a large preset area ratio, causing a small heat shrinkage, the value of the equation $$\frac{Y-4.5}{X}$$

in the range of the needle piercing resistance of over 1.2 kg becomes less than 1.25, and thus the shape retaining property becomes poor. Further, the abrasion resistance and the flexural endurance property of this nonwoven sheet are unsatisfactory.

As described hereinbefore, the formable nonwoven sheet having superior forming properties and utilizability can be obtained by applying the heat treatment for shrinking the YR type nonwoven sheet when the preset area ratio is between 10% and 60%.

TABLE 5

| | | Example | | | Reference Example |
|---|---|---|---|---|---|
| | | 25 | 26 | 27 | 28 |
| Condition of Heat Treatment | Temperature (°C.) | 110 | 130 | 150 | 90 |
| | Processing speed (m/min) | 20 | 16 | 13 | 30 |
| | Preset Area Ratio (%) | 56 | 42 | 30 | 72 |
| Properties of Nonwoven Sheet | Weight per Unit Area (g/cm$^2$) | 520 | 595 | 830 | 340 |
| | Apparent Density (g/cm$^3$) | 0.40 | 0.48 | 0.55 | 0.32 |
| | Breaking Elongation at 150° C. (%) | 370/350 | 390/360 | 430/390 | 310/270 |
| | Stress under Elongation of 30% at 150° C. (kg/cm$^2$) | 12/11 | 10/9 | 8/8 | 14/13 |
| | Needle Piercing Resistance [X] (kg) | 1.53 | 1.61 | 1.65 | 1.42 |
| | Hooking Resistance [Y] (kg) | 9.1 | 9.3 | 10.5 | 6.1 |
| | [Y]/[X] | 5.9 | 5.8 | 6.4 | 4.3 |
| | $\frac{[Y]-4.5}{[X]}$ | 3.0 | 3.0 | 3.6 | 1.13 |
| | Flexural Endurance Ratio (%) | 90/88 | 92/91 | 91/90 | 70/66 |
| | Air Permeability (cc/cm$^2$/sec) | 5 | 4 | 1 | 7 |
| | Abrasion Resistance (degree) | A | A | A | B |
| | Heat Deterioration (%) | 80/78 | 78/77 | 76/75 | 81/79 |
| Properties of Formed Part | Area Enlarging Ratio | 5.7 | 5.9 | 6.2 | 5.1 |
| | Difference of the height per Unit Area between Side and Bottom (%) | 8 | 9 | 9 | 18 |
| | Heat Resistance | 2 | 2 | 2 | 1 |
| | Shape Retention | ◎ | ◎ | ◎ | Δ |

Note:
A/B in Table express that A is a value in lengthwise direction of Nonwoven Sheet and B is same in widthwise direction.

I claim:

1. A formable nonwoven sheet composed of filaments of a polyester group and having an apparent density between 0.25 g/cm$^3$ and 0.80 g/cm$^3$ and a breaking elongation at 150° C. of 100% or more, characterized in that a relationship between a hooking resistance value Y and a needle piercing resistance value X of said formable nonwoven sheet is satisfied by the following equations (1) or (2);

$$Y/X \geqq 5.00 \quad (1)$$

where $0 < X \leqq 1.2$ $$\frac{Y-4.5}{X} > 1.25 \quad (2)$$

where $X > 1.2$

2. A formable nonwoven sheet according to claim 1, characterized in that a stress under elongation of 30% at 150° C. of said nonwoven sheet is 50 kg/cm$^2$ or less.

3. A formable nonwoven sheet according to claim 1, characterized in that a fineness of said polyester filament is between 0.2 denier and 20.0 denier.

4. A formable nonwoven sheet according to claim 1, characterized in that a weight per unit area of said nonwoven sheet is between 15 g/m$^2$ and 600 g/m$^2$.

5. A formable nonwoven sheet according to claim 1, characterized in that an average degree of roughness of at least one surface of said nonwoven sheet is 100 μm or less.

6. A formable nonwoven sheet according to claim 5, characterized in that the average degree of roughness of at least one surface of said nonwoven sheet is between 25 μm and 70 μm.

7. A formable nonwoven sheet according to claim 5, characterized in that said nonwoven sheet includes a plurality of minute concave portions on at least one surface thereof, and an area of one concave portion is between 0.01 mm$^2$ and 5.00 mm$^2$, and a depth of said concave portions from the surface of said nonwoven sheet is at least 20% of a thickness of said nonwoven sheet.

8. A formable nonwoven sheet according to claim 1, characterized in that said nonwoven sheet includes a plurality of minute concave portions on at least one surface thereof, and an area ratio of the total area of said concave portions to the corresponding whole area of said surface is between 5% and 50%.

9. A method for producing a formable nonwoven sheet, wherein a nonwoven web composed of filaments of a polyester group and having a breaking elongation at 24° C. of 100% or more and a birefringence index between $10\times10^{-3}$ and $70\times10^{-3}$ is formed on a conveyor net by drawing a group of filaments extruded from spinning nozzles by means of a high speed air current, said nonwoven web is partial-heat-press-bonded by means of a heated embossing roller having a plurality of convex portions, a surface temperature of which is kept at a temperature between (the second order transition temperature −30° C.) and (the second order transition temperature +30° C.) to make an intermediate nonwoven sheet, and said intermediate nonwoven sheet is heat-treated while controlling an area shrinkage of said intermediate nonwoven sheet caused by a heat, by holding said intermediate nonwoven sheet from both sides.

10. A method according to claim 9, wherein said intermediate nonwoven sheet is heat-treated after water between 1 wt % and 30 wt % for the weight of said nonwoven sheet is added to said nonwoven sheet.

11. A method according to claim 9, wherein said intermediate nonwoven sheet is heat-treated at a temperature between (the second order transition temperature) and (the melting point −60° C.).

12. A method according to claim 9, wherein said intermediate nonwoven sheet is heat-treated by means of a felt calender.

13. A method for producing a formable nonwoven sheet, wherein a nonwoven web composed of filaments of a polyester group and having a breaking elongation at 24° C. of 100% or more and a birefringence index between $10\times10^{-3}$ and $70\times10^{-3}$ is formed on a conveyer net by drawing a group of filaments extruded from spinning nozzles by means of a high speed air current, said nonwoven web is partial-heat-press-bonded by means of a heated embossing roller having a plurality of convex portions, a surface temperature of which is kept at a temperature between (the second order transition temperature) and (the second order transition temperature +50° C.) to make an intermediate nonwoven sheet, and said intermediate nonwoven sheet is heat treated while said intermediate nonwoven sheet is allowed to shrink from a heat of steam or boiling water.

14. A method according to claim 13, wherein said intermediate nonwoven sheet is heat-treated such that said intermediate nonwoven sheet shrinks to a shrunken nonwoven sheet having an area of between 10% and 60% of said intermediate nonwoven sheet.

15. A method according to claim 13, wherein said intermediate nonwoven sheet is heat-treated at a temperature between (the second transition temperature) and (the melting point −60° C.).

16. A method according to claim 13, wherein said intermediate nonwoven sheet is heat-treated in boiling water.

17. A method according to claim 13, wherein said intermediate nonwoven sheet is heat-treated by steam.

* * * * *